United States Patent [19]

Lathrop

[11] 4,111,425

[45] Sep. 5, 1978

[54] JIGSAW PUZZLE HOLDER AND DISPLAY APPARATUS

[75] Inventor: George Edward Lathrop, Bricktown, N.J.

[73] Assignee: The Lathrop Corporation of America, Clinton, N.J.

[21] Appl. No.: 755,130

[22] Filed: Dec. 29, 1976

[51] Int. Cl.[2] ..... A63F 9/00

[52] U.S. Cl. ..... 273/157 R; 40/156

[58] Field of Search ..... 273/157 R; 40/156

[56] References Cited

U.S. PATENT DOCUMENTS

| | | | |
|---|---|---|---|
| 1,987,496 | 1/1935 | Springborn | 273/157 R |
| 3,599,361 | 8/1971 | Bowman et al. | 40/156 |
| 4,026,559 | 5/1977 | Carlton | 273/157 R |

FOREIGN PATENT DOCUMENTS

| | | | |
|---|---|---|---|
| 1,181,232 | 2/1970 | United Kingdom | 273/157 R |

OTHER PUBLICATIONS

"Wordless Workshop", Popular Science, Dec. 1976 (publication date about 11-15-77), p. 120.

*Primary Examiner*—Anton O. Oechsle

*Attorney, Agent, or Firm*—Charles I. Brodsky

[57] ABSTRACT

A jigsaw puzzle holder and display apparatus which permits easy organization and construction of a puzzle, and a manner of displaying the puzzle even if only partially complete.

8 Claims, 6 Drawing Figures

JIGSAW PUZZLE HOLDER AND DISPLAY APPARATUS

FIELD OF THE INVENTION

This invention relates to the construction of jigsaw puzzles and, more particularly, to apparatus which simplifies the construction of a puzzle and provides a manner by which the puzzle can be displayed, independent of its stage of completion.

BACKGROUND OF THE INVENTION

As will be readily appreciated, the doing of jigsaw puzzles is a very popular past-time. Many puzzles commercially available today announce an appeal to a populace from "six-to-sixty" and from "seven-to-seventy." In fact, jigsaw puzzles are even available to children of pre-school age, not only as a means of entertainment, but as a learning device. Presently available puzzles come in all sizes and shapes — square, rectangular, round, diamond, and triangular, for example —, and with varying numbers of pieces, e.g., 100, 200, 500, 1000, both of the "inter-locking" and "non-interlocking" variety. However, one limitation of all these prior arrangements is that it requires a large work area for the person doing the puzzle — usually, the kitchen or dining room table, or a living room or family room floor. In most instances, wherein the puzzle is not completed at one sitting, it is not unusual to find that table area or room area then unavailable for other family use, for to do so, would mean to interfere with the started puzzle construction.

A second limitation of present day puzzles concerns the manner in which they are displayed. By and large, most people, when they complete the puzzle, dismantle it shortly thereafter, and do not display it in the manner that they would a picture or a mirror, hanging from a wall, for example. Some others, however, do in fact display the completed puzzle, either by shellacing or similarly varnishing or adhesively sealing the pieces, and then standing the puzzle on its side, or by inserting it, after such shellacing, varnishing, etc., into a picture frame which they then display. As will be readily apparent, in both of these latter display arrangements, the puzzle can no longer be broken down and put together again some time in the future, the shellacing, varnishing or sealing process being permanent in nature.

SUMMARY OF THE INVENTION

The jigsaw puzzle holder and display apparatus of the present invention, on the other hand, will be seen to permit a puzzle to be constructed in a person's lap — for example, when sitting in a chair (as when watching television), or while sitting in a bed with the puzzle draped across the legs or up against bended knees — as well as at a table or on a floor. If the puzzle cannot be completed in one sitting, the apparatus of the invention permits easy storage of the partially completed puzzle without any need for dismantling it and, if desired, permits the hanging of the incomplete puzzle at that time, to be displayed thereby as a conversation piece, even in unfinished form. Once the puzzle is completed, it can be displayed just as a picture or mirror is hung, or can be dismantled and broken down, with the apparatus then still being available for the construction and display of other puzzles of comparable size. A degree of variety is thus permitted in the display of puzzles in accordance with ones desires and preferences at any given time.

As will become clear hereinafter, a preferred embodiment of the apparatus of the invention comprises a construction platform configured for the intended puzzle and a surrounding tray for the containment, assortment and organization of puzzle pieces during construction, and for the storage of left-over pieces between construction sessions. A resilient pad overlies the construction platform, providing sufficient frictional forces to hold the puzzle pieces in place with minimum slippage during the construction, and dimensioned such that when a clear plastic cover is placed over the construction platform, the pad permits a slight inwardly directed compression from the force of the cover against the puzzle pieces, to further hold the puzzle pieces in place. It will be readily appreciated, that by appropriately dimensioning the depth of the construction platform with respect to the thickness of the puzzle pieces, the cover can establish a holding force sufficient to permit the apparatus to be hung vertically, even though the puzzle may not yet be completed and parts of it remain unconnected.

BRIEF DESCRIPTION OF THE DRAWINGS

These and other features of the invention will be more clearly understood from a consideration of the following description taken in connection with the accompanying drawings in which:

FIG. 6 shows an arrangement for simplifying the puzzle construction by means of a clip attachment to display a picture illustrating what the completed puzzle should look like.

DETAILED DESCRIPTION OF THE DRAWINGS

Figure 1:
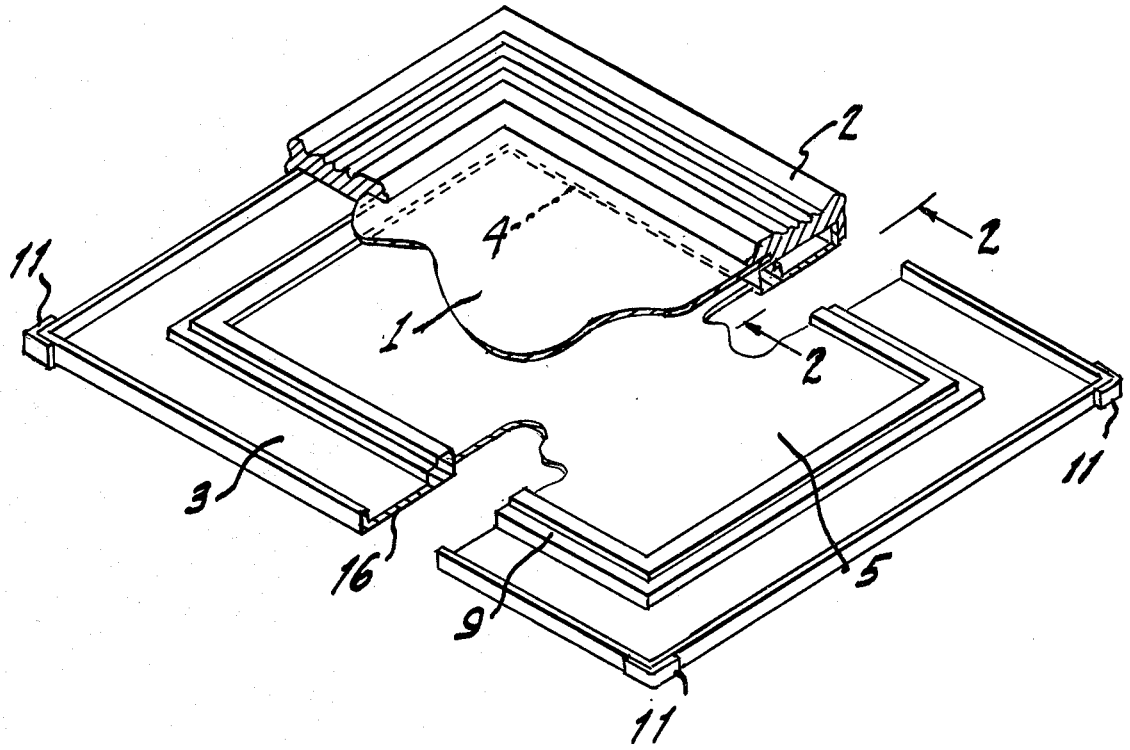
FIG. 1 shows an isometric view of a preferred embodiment of a jigsaw puzzle holder and apparatus constructed in accordance with the principles of the present invention, and partially in broken form for ease of understanding.

Referring now, more particularly, to the drawings, the reference numeral 16 represents the base of the jigsaw puzzle holder, having a recess or tray therein 3 in which the puzzle pieces can be stored between construction sessions and in which the puzzle pieces can be assorted during the actual construction. (It will be readily appreciated that the jigsaw puzzle holder and apparatus of the invention could be manufactured for sale already packaged with 100, 200, 500, 1000, etc., puzzle pieces for construction contained within the tray 3, or could be sold separately, the puzzle pieces then being transferred to the tray 3 from a package sold as a separate unit.)

Reference numeral 5 represents the construction platform where the puzzle is to be built, and is configured, in a preferred embodiment of the invention, to provide approximately a 1 millimeter clearance beyond the size of the completed puzzle, measured in both planar directions. Overlying the construction platform 5 is a resilient pad-like material 6 (e.g., thin styrofoam or a foam rubber matting) of sufficient roughness to provide a sideways frictional force in holding the puzzle pieces in place during construction, and to afford sufficient "give" to permit the puzzle pieces to be compressed inwardly into the pad 6 when a clear plastic cover 1 is placed atop the construction platform 5 to hold the pieces in place when the puzzle is hung. In order to provide enhanced contrast for the puzzle pieces during construction, the pad 6 can be fabricated of a light color. (In the version herein described, the cover portion 1 is of a clear, see-through acrylic fabrication, to be non-breakable and durable, while protecting the puzzle from dust and damage.) Reference numeral 7 shows a recess into which the puzzle pieces are placed, on top of the resilient paddding 6, when the puzzle is bing constructed, and is of a depth sufficient to accept and hold the pieces in place during contruction, yet cooperating with the resiliency of the pad 6 to permit the puzzle pieces to fit below the cover 1 when the cover is in position. That is, the depth of recess 7 is selected in conjunction with the clearance provided by construction platform 5 around the completed puzzle so as to substantially hold a completed puzzle in place, even without the cover 1 being attached, while yet permitting the cover 1 to be affixed flat to compressibly hold individual puzzle pieces in place even when the puzzle is unfinished. In one construction of the invention, the depth of recess 7 was selected approximately 1 millimeter.

Figure 2:
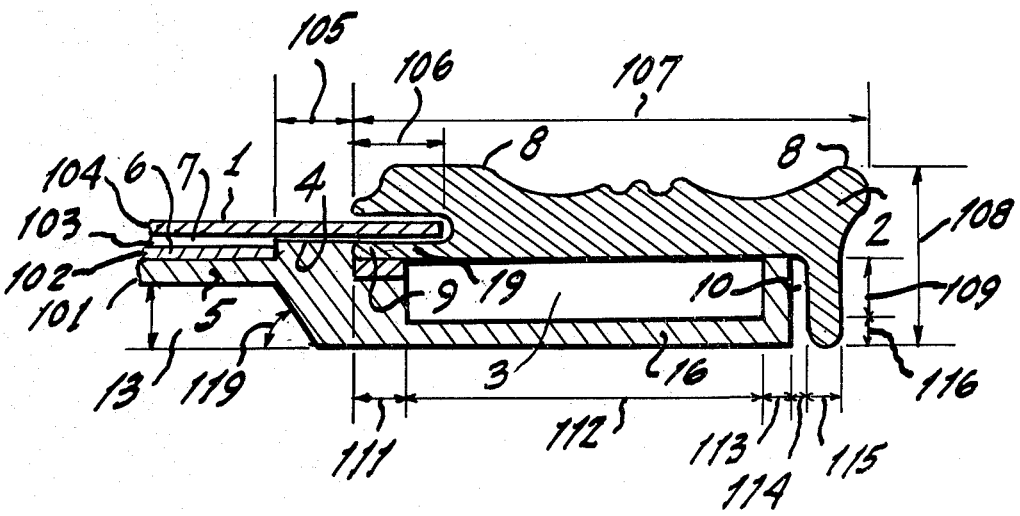
FIG. 2 is a section view along the line A—A of FIG. 1, helpful in an understanding of the invention.
Figure 3:
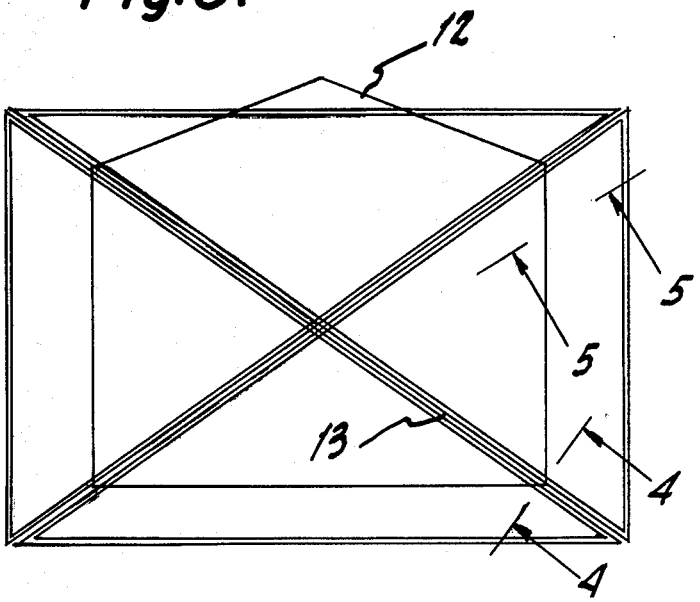
FIG. 3 is a rear view of the apparatus of the invention.
Figure 4:
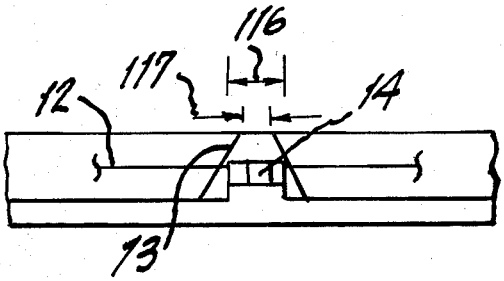
FIGS. 4 and 5 are section views taken along the lines B—B and C—C, respectively, of FIG. 3, also helpful in an understanding of the invention.
Figure 5:
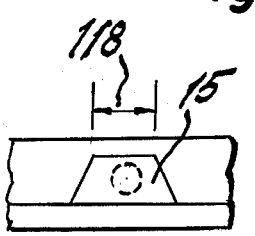
Figure 6:
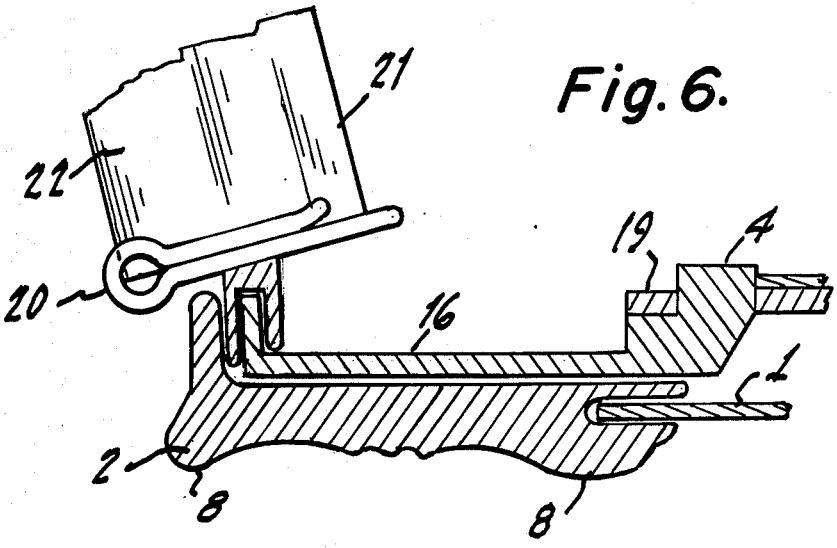

Although it is possible for the acrylic cover 1 to be dimensioned to extend over the tray 3 itself, a decorative frame 2 is employed in closing the puzzle construction, being configured to receive the cover 1 and to overlie the base 16, and of a width to conceal the tray 3 with an attractive appearance — a wood-grain finish fabricated from a high density polystyrene foam material, for example. As is more clearly shown in FIG. 6, the top most surfaces 8 of the frame 2 are at the same elevation so as to provide a stable foundation for the entire apparatus during the construction phases. That is, when the cover 1 and the frame 2 are removed, they can be inverted to accept the base 16 which then fits within them, the cover 1 then being stored under the construction platform 5 but with raised surfaces so as to prevent scratching of the acrylic face of the cover 1 during those times when the construction is being completed on a hard surface, such as a table or floor. A plurality of spacers 11 are affixed at each corner of the base 16, to properly align the cover 1 and decorative frame 2 when placed over the completed construction, while imposing minimal frictional resistance during the lifting away and replacement over the base 16. Reference numeral 10 (FIG. 2) indicates the spacing which exists between the frame 2 and the edge of the base 16 to show the ease with which the cover 1 can be removed and replaced. To set off and highlight the puzzle when it is completed, a light colored border 4 is incorporated, against the inside of which the border puzzle pieces bear.

To assist in holding the cover 1 in overlying position with the construction platform 5 and the jigsaw puzzle pieces inserted in place, both the frame 2, at an underside 9, and the base 16, at an upper position 19, are constructed with magnetic edgings, i.e., ribbons of material impregnated with magnetic particles, to mate with each other in providing sufficient attraction to hold the cover 1 in place and to provide a dust resistant seal. With the cover 1 thus held in place, it will be noted that sufficient magnetic forces of attraction can be made to exist to force the puzzle pieces inwardly of the resilient padding 6 and construction platform 5, so as to hold them in place even though the puzzle pieces may be unconnected in places. As a result, and when supplemented by the frictional force provided by the makeup of the resilient padding 6 itself, even an incompleted puzzle can be held in place, appropriate for hanging and display, independent of the percentage amount of completion.

In any stage of completion or incompletion, the jigsaw puzzle can thus be displayed, with the apparatus described, either vertically or horizontally, by means of a heavy gauge hanger wire or cable 12 traversing a plurality of reinforcing cross ribs or braces 13 cast into the base 16 to increase support. Again, to enhance stability during the puzzle construction process, the depth of the reinforcing rib 13 is selected such that its lower most surface is in the same plane with the bottom of the storage platform recess 5 — thus assuring that the base will continue to lie flat on a hard table or floor surface. Metal grommets are provided through holes in the reinforcing braces 13 to receive the hanger wire 12, the rib being also recessed, as at 15, to provide a flattened surface for the attachment of the grommets 14.

While applicant does not wish to be limited to any particular set of dimensions, the following have proved useful in one embodiment of the present invention:

| | | | |
|---|---|---|---|
| Dimension | 100 | 10 | millimeters |
| Dimension | 101 | 4 | millimeters |
| Dimension | 102 | 3 | millimeters |
| Dimension | 103 | 1 | millimeters |
| Dimension | 104 | 2.5 | millimeters |
| Dimension | 105 | 13 | millimeters |
| Dimension | 106 | 15 | millimeters |
| Dimension | 107 | 85 | millimeters |
| Dimension | 108 | 30 | millimeters |
| Dimension | 109 | 10 | millimeters |
| Dimension | 110 | 4 | millimeters |
| Dimension | 111 | 8 | millimeters |
| Dimension | 112 | 60 | millimeters |
| Dimension | 113 | 4 | millimeters |
| Dimension | 114 | 3 | millimeters |
| Dimension | 115 | 5 | millimeters |
| Dimension | 116 | 8 | millimeters |
| Dimension | 117 | 5 | millimeters |
| Dimension | 118 | 10 | millimeters |

At the same time, the spacers 11 were selected 15 millimeters on a side, an angle of 60° was selected for the dimension 119 to enhance stability, and the dimensions selected for the construction platform 5 were chosen of the same size of the completed puzzle plus 1 millimeter, so as to limit slippage while at the same time permitting for easy removal and replacement.

As was previously described, the jigsaw puzzle holder and display apparatus of the invention can also be used for puzzles which are purchased in their own separate boxes. When the puzzle is being worked on at a kitchen table, it is not too difficult to stand the cover of the box in the area of the puzzle holder in order to give to the person fabricating the puzzle, an idea of what the completed puzzle should look like, so as to facilitate his construction of it. This becomes more cumbersome, however, where the puzzle user is sitting in a chair, or lying on a bed, because the puzzle box cover is usually placed aside. In accordance with the present invention, however, a spring clip 20 can be employed (FIG. 6), dimensioned to snugly fit over an edge of the turned-up base 16, in holding the box cover 22 in place, with the picture scene 21 facing the puzzle builder. In this manner, one leg of the clip 20 can fit within the recess 10 between the frame 2 and the base 16 to be held snugly in place. In one embodiment of the invention, a spring clip was used of 50 millimeters overall length, 10 millimeters width, and with 16 millimeters deep legs so as to tilt the box upwardly at an angle of 15° from the vertical in presenting to the jigsaw puzzle builder a view of what the completed puzzle should look like.

While there has been described what is considered to be a preferred embodiment of the present invention, it will be readily apparent that modifications may be made by those skilled in the art without departing from the scope of the teachings herein. For example, the jigsaw puzzle holder might be fabricated such that the cover 1 only overlies the construction platform 5, there being no desire to utilize a storage tray arrangement 3 for puzzle pieces during the construction process. Or, instead of a decorative frame 2, decorative contact paper can serve as a border edge to the cover 1 to overly the tray 3 when used. Such modifications are well within the skill of the art, as are manners to secure the cover 1 to the base 16 through the use of matting pegs in one, with holes in the other. In such instance, furthermore, one might design the cover 1 as a horizontal pane of plastic or glass material, without the illustrated right-angular edges which fit over the upright sides of the base 16 in increasing support and rigidity. While such modifications may be made, such and other variations are intended to fit within the scope of the claims defining this invention as are appended hereto. Thus, the invention is to be read in light of the claims, understanding that the principles defined thereby are appropos whether the jigsaw puzzle be constructed rectangular in shape, as shown, or whether it be round, triangular, square, diamond, etc.

I claim:

1. Jigsaw puzzle apparatus comprising:

a work area for the assembly of component puzzle pieces, said work area being configured and arranged so as to hold a completed puzzle substantially in place; and a cover overlying said work area in a manner to impart a compressive force upon said puzzle pieces in further holding said completed puzzle in substantially aligned relationship;

wherein said work area includes a construction platform, a raised border surrounding said construction platform, and a resilient pad atop said platform to receive said puzzle pieces and to permit said puzzle pieces to be compressed inwardly thereof when said cover is placed in overlying relationship therewith;

wherein said resilient pad is selected of sufficient roughness to provide a sideways frictional force to hold said puzzle pieces in place during the construction of said jigsaw puzzle;

and wherein said construction platform and said surrounding raised border are dimensioned for the particular accommodation of the given puzzle to be held;

and wherein there is also included a tray fixedly circumscribing said surrounding raised border and construction platform for the containment, assortment and organization of individual puzzle pieces during the construction of said jigsaw puzzle.

2. The apparatus of claim 1 wherein said overlying cover imparts a compressive force upon said puzzle pieces sufficient to hold said pieces in place even when said puzzle is in incomplete form.

3. The apparatus of claim 1 wherein said overlying cover has a see-through capability for displaying the puzzle pieces held in place thereby.

4. The apparatus of claim 3 wherein there is also included means affixed to a rear portion of said work area for the hanging of said apparatus in displaying the puzzle pieces held in place by said work area and by said overlying cover.

5. The apparatus of claim 1 wherein said surrounding raised border and said overlying cover include cooperating means to hold said overlying cover secure against said work area when in place.

6. The apparatus of claim 1 wherein said overlying cover also overlies said tray to provide a compartment for the storage of left-over puzzle pieces between construction sessions.

7. The apparatus of claim 6 wherein said overlying cover has a see-through capability in an area substantially co-extensive with said construction platform and said surrounding raised border, and a decorative, non-see-through capability in an area substantially co-extensive with said tray, whereby substantially only the puzzle pieces held in place by said overlying cover in said construction platform will be displayed.

8. The apparatus of claim 7 wherein said surrounding raised border is selected of a color to visibly contrast with the colors of the puzzle pieces positioned in immediate placement adjacent thereto.

* * * * *